US005346308A

United States Patent [19]

Buhot et al.

[11] Patent Number: 5,346,308

[45] Date of Patent: Sep. 13, 1994

[54] BAG WITH STORAGE POCKET WHICH CONVERTS INTO A BEACH TOWEL

[76] Inventors: Dominique J. Buhot; Rena Ross, both of P.O. Box 4414, Winter Park, Fla. 32793-4414

[21] Appl. No.: 928,287

[22] Filed: Aug. 12, 1992

[51] Int. Cl.[5] ..... B65D 30/10

[52] U.S. Cl. ..... 383/4; 224/153; 383/31

[58] Field of Search ..... 383/4, 907, 30, 31; 5/419, 413; 224/153, 156, 901

[56] References Cited

U.S. PATENT DOCUMENTS

| | | | |
|---|---|---|---|
| 3,948,528 | 4/1976 | Goodman, Jr. et al. | 383/4 X |
| 4,101,994 | 7/1978 | Hoyt | 383/4 |
| 4,154,323 | 5/1979 | Sneider | 383/4 X |
| 4,188,988 | 2/1980 | Agyagos | 383/4 |
| 4,197,891 | 4/1980 | Comollo | 383/4 |
| 4,375,111 | 3/1983 | Hall | 383/4 X |
| 4,423,834 | 1/1984 | Rush | 224/153 X |
| 4,489,815 | 12/1984 | Martinez et al. | 383/4 |
| 4,671,393 | 6/1987 | Rainey | 383/4 X |
| 4,774,734 | 10/1988 | Mills | 224/156 X |
| 4,778,090 | 10/1988 | Facchina | 383/4 X |
| 4,991,245 | 2/1991 | Franco | 383/4 X |
| 5,048,975 | 9/1991 | Holbrook | 383/4 |
| 5,110,219 | 5/1992 | Lopes | 383/4 |
| 5,170,917 | 12/1992 | Tourigny | 224/901 X |

FOREIGN PATENT DOCUMENTS

| | | | |
|---|---|---|---|
| 99135 | 1/1925 | Austria | 224/156 |
| 56042 | 1/1911 | Switzerland | 224/156 |

*Primary Examiner*—Allan N. Shoap
*Assistant Examiner*—Christopher McDonald
*Attorney, Agent, or Firm*—Paul S. Rooy

[57] ABSTRACT

A bag with storage pocket which converts into a beach towel comprising a bag front wall attached to a beach towel and a flap. The flap further comprises a zippered storage compartment. One or more shoulder straps are attached to the bag with storage pocket which converts into a beach towel in order to provide hands-free transportation of the items contained in the bag with storage pocket which converts into a beach towel and the storage compartment.

11 Claims, 4 Drawing Sheets

BAG WITH STORAGE POCKET WHICH CONVERTS INTO A BEACH TOWEL

STATEMENT AS TO RIGHTS TO INVENTIONS MADE UNDER FEDERALLY SPONSORED RESEARCH AND DEVELOPMENT

No such rights exist.

BACKGROUND OF THE INVENTION

1. Field of the Invention

The instant invention relates to beach accessories and in particular to a bag with storage compartment which converts into a beach towel.

2. Background

Each year hundreds of millions of people go to the beach to enjoy the invigorating salt ocean air, a bracing swim in the surf and a lazy afternoon lounging in the warm sun. The health and psychological benefits afforded by these activities are numerous and virtually universally recognized.

Typically these excursions involve a car (or bus, train, subway, etc.) ride to the parking lot or train station nearest the destination beach followed by a sometimes long walk to the beach itself. Generally the beachgoer caries a number of items with him to the beach: sunblock, beach towel, reading material, radio, food, sun glasses, etc.. All these items must be carried from the vehicle to the beach. Fitting these items in an average size bag can be problematic: sometimes the beachgoer is forced to carry the beach towel separately from the bag due to limited bag capacity, which creates additional work and inconvenience for the beachgoer.

In addition, the beachgoer frequently needs to have his hands free to carry other items of beach equipment such as beach chairs and coolers. Many conventional beach bags make no provision for hands-free use (such as back pack style shoulder straps, etc.).

One approach to solving this beach equipment transport problem is disclosed in U.S. Pat. No. 4,671,393 granted to Rainey. This patent is for a mat foldable into an insulated bag. This design suffers the drawbacks of being semi-rigid (which makes it bulky to store) and no provisions are taught to render its transport hands-free.

SUMMARY OF THE INVENTION

Accordingly, it is an object of this invention to provide a bag with storage pocket that converts into a beach towel wherein the beach towel is conveniently stored inside the bag until it is desired to make use of the beach towel, at which point the beach towel can be quickly unfolded from the bag and used.

It is another object of this invention to provide a bag with storage pocket that converts into a beach towel whose design provides for hands-free use. Design features allowing the accomplishment of this object include one or more adjustable length shoulder straps attached to the bag. Advantages to the user include the ability to use one's hands to transport other beach equipment such as beach chairs, coolers, etc..

Still a further object of this invention is to provide a bag with storage pocket that converts into a beach towel capable of securely holding small articles such as jewelry, billfolds, sun glasses, etc.. Design features permitting this object to be achieved include a bag incorporating a small, closable storage compartment on the inside of the bag flap. Advantages to the user include reduced chance of loss of the items in the storage compartment and added convenience to the user.

Another object of this invention is to provide a bag with storage pocket that converts into a beach towel large enough to readily hold a large number of items customarily required by the beachgoer.

It is still another object of this invention to provide a bag with storage pocket that converts into a beach towel manufactured of readily available materials so as to render the bag with storage pocket that converts into a beach towel easily affordable to the consumer.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIGS. 1, 2, and 3. Sheet two contains FIGS. 4, 5, 6 and 7. Sheet three contains FIGS. 8, 9, 10 and 11. Sheet four contains FIGS. 12, 13, 14 and 15.

DETAILED DESCRIPTION OF THE PREFERRED EMBODIMENT

Figure 1:
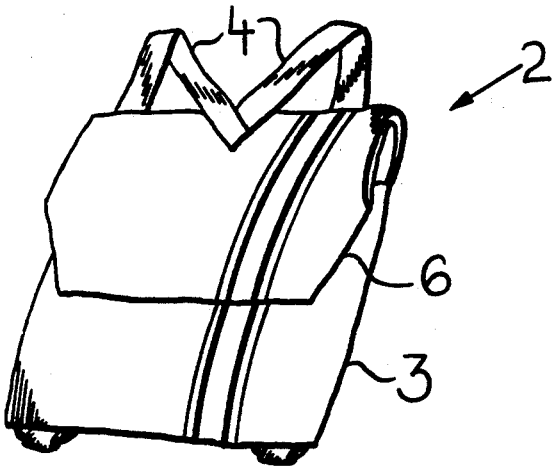
FIG. 1 is a front isometric view of a bag with storage pocket which converts into a beach towel, folded into the closed bag configuration.

Referring now to FIG. 1 we can observe a front isometric view of a bag with storage pocket which converts into a beach towel 2 folded into the closed bag configuration. Flap 6 closes bag 3; shoulder straps 4 are provided in order to allow bag with storage pocket which converts into a beach towel 2 to be worn backpack style in order to afford the wearer hands-free use.

Figure 2:
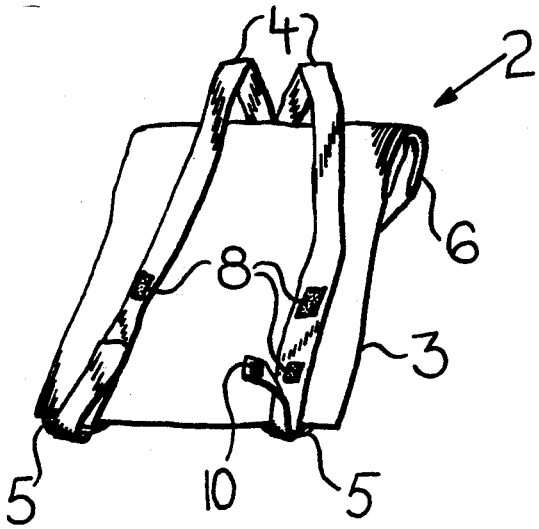
FIG. 2 is a rear isometric view of a bag with storage pocket which converts into a beach towel folded into the closed bag configuration.

FIG. 2 is a rear isometric view of bag with storage pocket which converts into a beach towel 2 folded into the closed bag configuration. One end of each shoulder strap 4 is attached to flap 6 (the end of shoulder straps 4 may be attached at a different location on flap 6); the other end of each shoulder strap 4 passes through a strap loop 5. Strap loops 5 are attached to the bottom of bag 3.

A plurality of strap hook and loop materials 8 are attached along the length of shoulder straps 4; end hook and loop material 10 is attached to the end of shoulder strap 4 which is not attached to flap 6. The length of shoulder straps 4 may be adjusted by varying which strap hook and loop material 8 end hook and loop material 10 is mated with.

Figure 3:
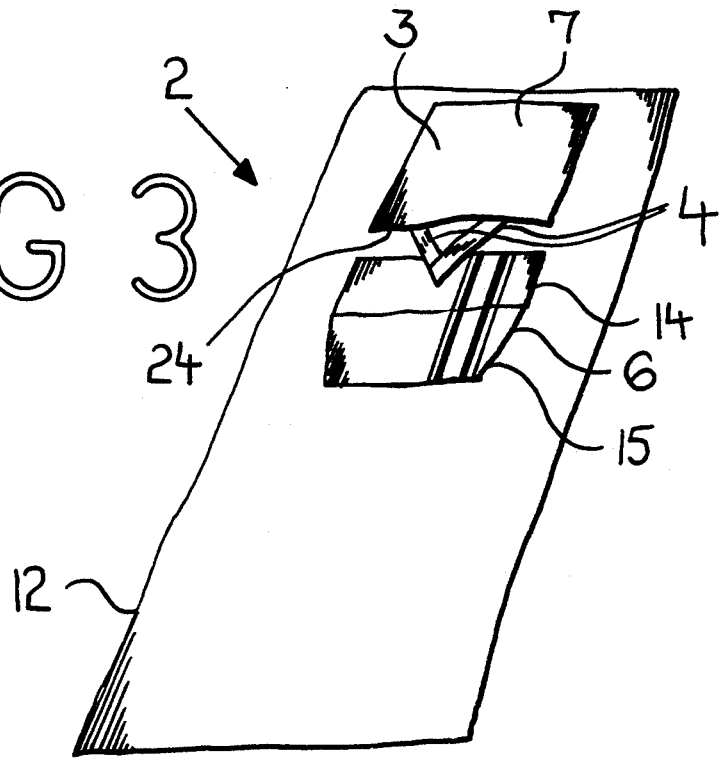
FIG. 3 is a front isometric view of a bag with storage pocket which converts into a beach towel unfolded into the beach towel configuration.

FIG. 3 is a front isometric view of bag with storage pocket which converts into a beach towel 2 unfolded into the beach towel configuration.

Bag 3 is comprised of bag front wall 7 which is attached to beach towel 12 along three sides, the fourth side comprises bag mouth 24. Shoulder straps 4 are stored within bag 3. Other beach items may also be stored within bag 3 by introducing them into bag 3 through bag mouth 24.

Flap 6 comprises flap base 14 attached to beach towel 12 and free flap 15 rotatably attached to flap base 14.

FIGS. 4–12 depict the method of folding bag with storage pocket which converts into a beach towel 2 from the beach towel configuration onto the closed bag configuration.

Figure 4:
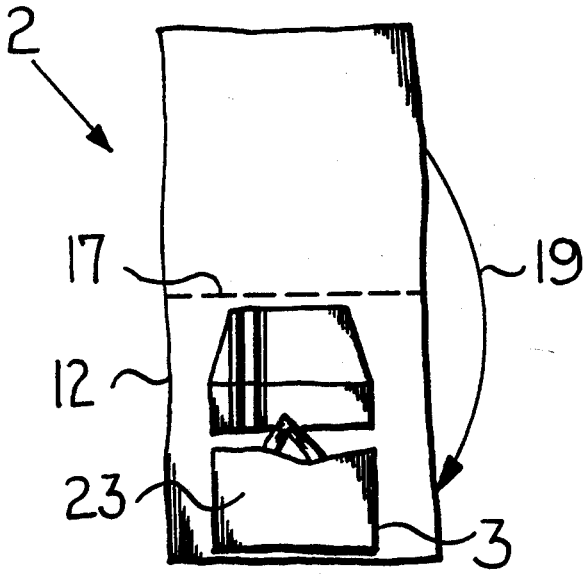
FIG. 4–12 depict the steps required to fold the bag with storage pocket which converts into a beach towel from the beach towel configuration into the closed bag configuration.

FIG. 4 depicts bag with storage pocket which converts into a beach towel 2 in the beach towel configuration. The inside of bag front wall 23 is outermost when bag with storage pocket which converts into a beach towel 2 is in the beach towel configuration.

Figure 5:
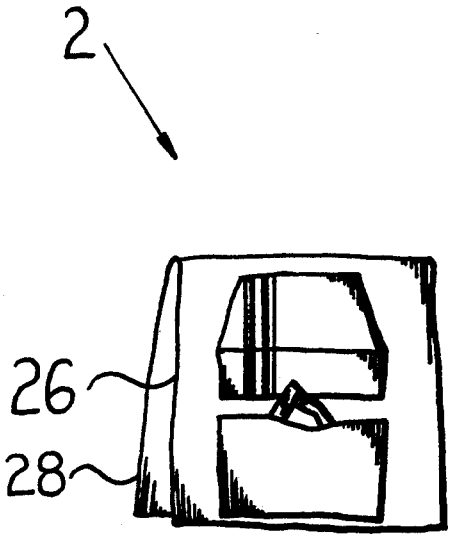

Upon folding the top of beach towel 12 backwards along top fold dashed line 17 as indicated by top fold arrow 19 we have top fold 26 superimposed on a bottom fold 28 as shown in the front view of bag with storage pocket which converts into a beach towel 2 depicted in FIG. 5.

Figure 6:
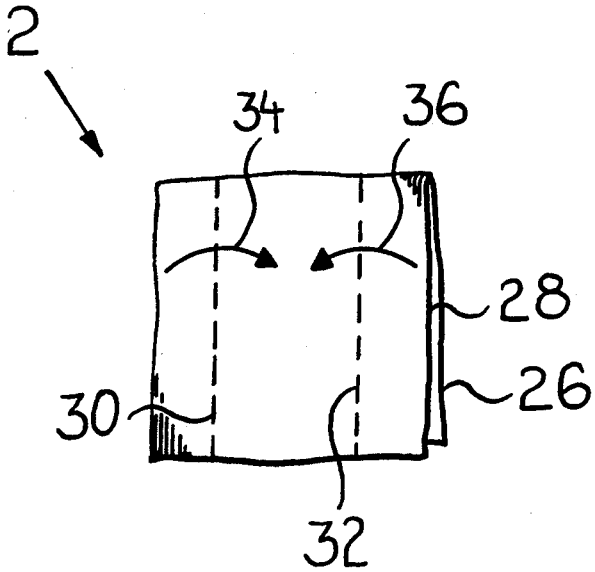

FIG. 6 is a rear view of the bag with storage pocket which converts into a beach towel 2 configuration illustrated in FIG. 5.

Figure 7:
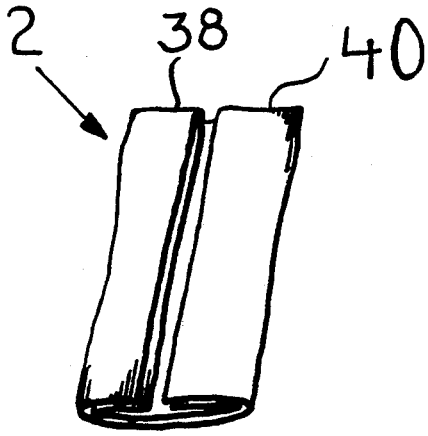

Upon folding the sides of top fold 26 and bottom fold 28 inwards along left dashed line 30 and right dashed line 32 as indicated by left fold arrow 34 and right fold arrow 36 we arrive at the configuration shown in the rear view of FIG. 7 where we have a left fold 38 butting up against a right fold 40.

Figure 8:
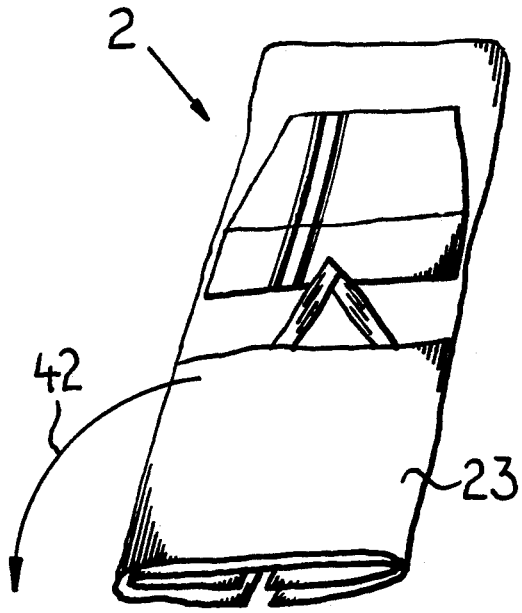

FIG. 8 is a front view of the bag with storage pocket which converts into a beach towel 2 configuration shown in FIG. 7. Our next step is to turn bag 3 inside out as indicated by bag inside out arrow 42.

Figure 9:
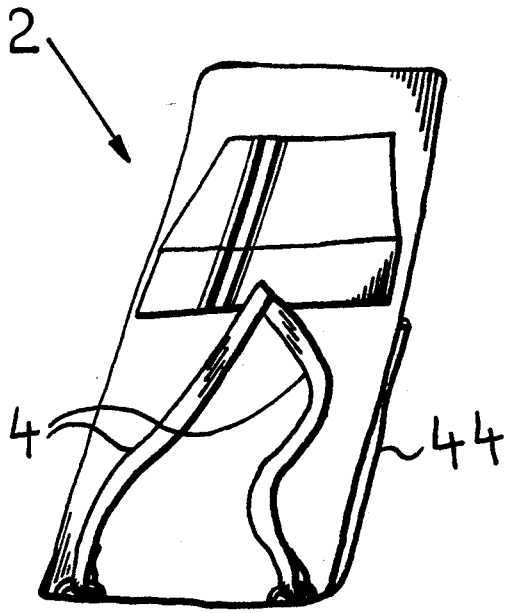

FIG. 9 is a rear isometric view of bag with storage pocket which converts into a beach towel 2 after we have turned bag 3 inside out. Where previously the inside of bag front wall 23 had been visible, now the outside of bag front wall 44 is exposed.

Figure 10:
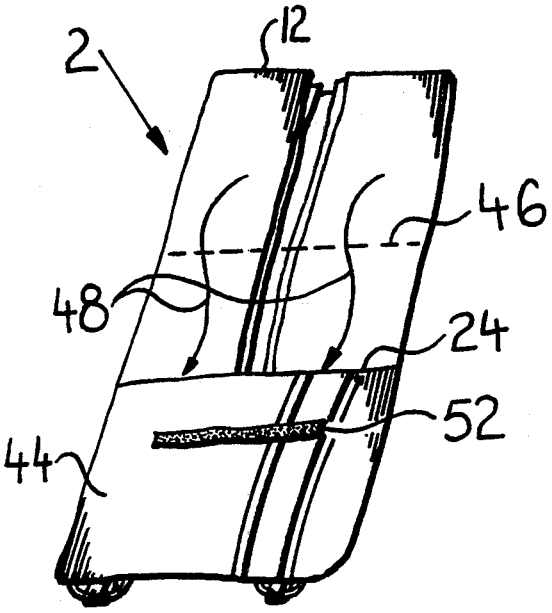

FIG. 10 is a front isometric view of the bag with storage pocket which converts into a beach towel 2 configuration depicted in FIG. 9. Bag front wall hook and loop material 52 is attached to outside of bag front wall 44.

Figure 11:
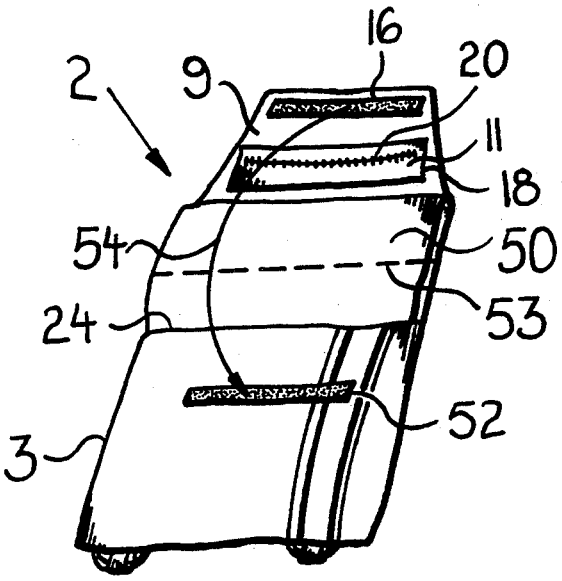

The top of beach towel 12 is now folded forward into bag mouth 24 along final fold dashed line 46 as indicated by final fold arrows 48 in order to arrive at the configuration having final fold 50 shown in FIG. 11.

FIG. 11 is a front isometric view of bag with storage pocket which converts into a beach towel 2 in the open bag configuration. A wide variety of items to be transported may be inserted in bag 3 through bag mouth 24.

Flap 6 is comprised of flap base 14 attached to beach towel 12, free flap 15 rotatably attached to flap base 14, flap hook and loop material 16 attached to inner side of free flap 9 and storage pocket 18.

Storage pocket 18 is comprised of storage pocket zipper wall 11 attached at its perimeter to inner side of free flap 9 and storage pocket zipper 20 installed in storage pocket zipper wall 11. When storage pocket zipper 20 is open, items may be placed within storage pocket 18; when storage pocket zipper 20 is closed, the items within storage pocket 18 are securely held within storage pocket 18 for safe-keeping.

Items may be stored within bag 3 or storage compartment 18 regardless of whether bag with storage pocket which converts into a beach towel 2 is in the beach towel or the bag configuration.

Figure 12:
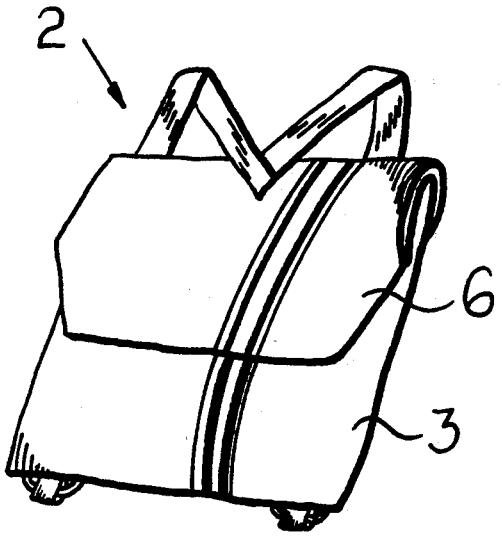

Bag with storage pocket which converts into a beach towel 2 is closed for transport by folding flap 6 forward along closing fold dashed line 52 as indicated by closing fold arrow 54 and mating flap hook and loop material 16 with the corresponding bag front wall hook and loop material 52, thereby arriving at the closed bag configuration shown in FIG. 12.

Figure 13:
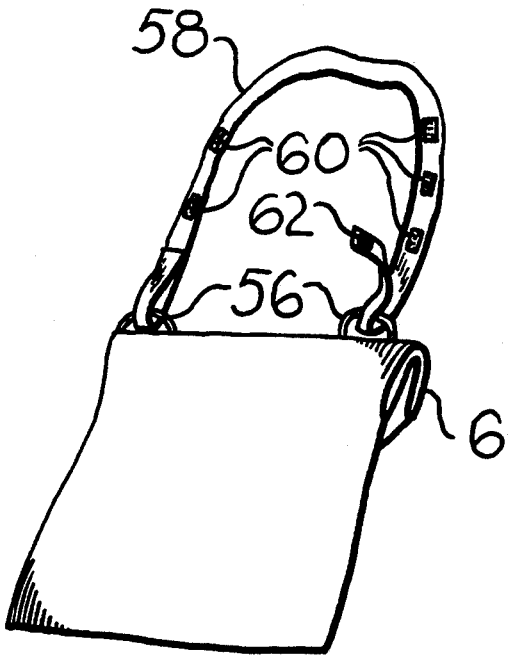
FIG. 13 depicts an alternate embodiment of a bag with storage pocket which converts into a beach towel which incorporates a singular shoulder strap.

FIG. 13 is a front isometric view of an alternate embodiment of bag with storage pocket which converts into a beach towel 2 which incorporates a singular shoulder strap 58. Each end of singular shoulder strap 58 passes through a shoulder strap loop 56 attached to flap 6. Singular shoulder strap hook and loop material 60 is attached to singular shoulder strap 58 along its length, and mating singular shoulder strap end hook and loop material 62 is attached to the ends of singular shoulder strap 58. The length of singular shoulder strap 58 may be varied by altering the singular shoulder strap hook and loop material 60 with which the singular shoulder strap end hook and loop material 62 is mated.

Figure 14:
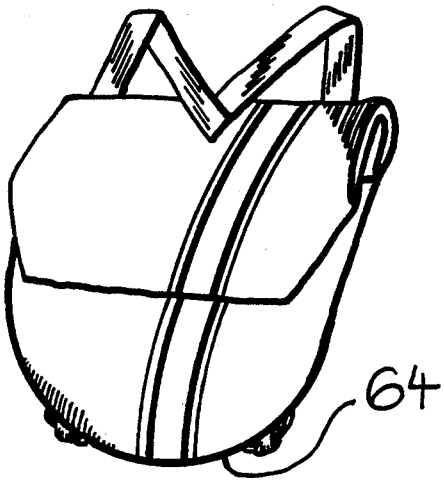
FIG. 14 depicts an alternate embodiment of a bag with storage pocket which converts into a beach towel which incorporates a curved bag bottom.

FIG. 14 is a front isometric view of an alternate embodiment of bag with storage pocket which converts into a beach towel 2 which incorporates a curved bag bottom 64.

Figure 15:
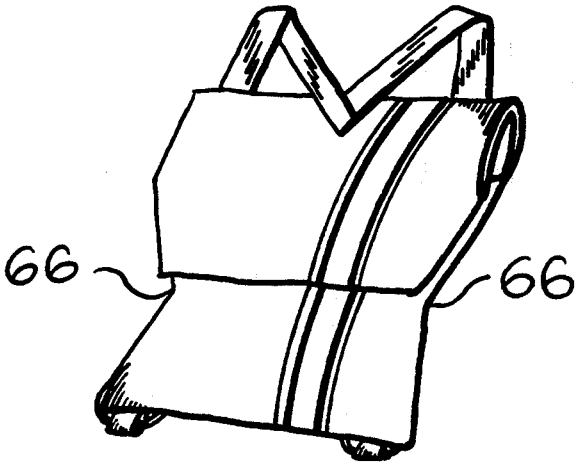
FIG. 15 depicts an alternate embodiment of a bag with storage pocket which converts into a beach towel which incorporates bag side indentations.

FIG. 15 is a front isometric view of an alternate embodiment of bag with storage pocket which converts into a beach towel 2 which incorporates bag side indentations 66.

Flap 6 and bag front wall 7 may be made of cloth or other appropriate material. Shoulder straps 4, strap loops 5, storage pocket zipper wall 11, singular shoulder strap 58 and shoulder strap loops 56 may be made of cloth or other appropriate material. The various pieces of hook and loop material may be velcro type hook and loop material or other appropriate fastener material. Storage pocket zipper 20 may be made of metal or synthetic material or other appropriate material. Beach towel 12 may be made of terry cloth or other appropriate material.

While a preferred embodiment of the invention has been illustrated herein, it is to be understood that changes and variations may be made by those skilled in the art without departing from the spirit and scope of the appending claims.

DRAWING ITEM INDEX 2 bag with storage pocket which converts into a beach towel
3 bag
4 shoulder strap
5 strap loop
6 flap
7 bag front wall
8 strap hook and loop material
9 inner side of free flap
10 end hook and loop material
11 storage pocket zipper wall
12 beach towel
14 flap base
15 free flap
16 flap hook and loop material
17 top fold dashed line 18 storage pocket
19 top fold arrow
20 storage pocket zipper
23 inside of bag front wall
24 bag mouth
26 top fold
28 bottom fold
30 left dashed line
32 right dashed line
34 left fold arrow
36 right fold arrow
38 left fold
40 right fold
42 bag inside out arrow
44 outside of bag front wall
46 final fold dashed line
48 final fold arrow
50 final fold
52 bag front wall hook and loop material
53 closing fold dashed line
54 closing fold arrow
56 shoulder strap loop
58 singular shoulder strap
60 singular shoulder strap hook and loop material
62 singular shoulder strap end hook and loop material
64 curved bag bottom
66 bag side indentation

We claim:

1. A bag with storage pocket which converts into a beach towel comprising:

a beach towel, a bag front wall attached to said beach towel, a flap attached to said beach towel, said flap comprising a flap base attached to said beach towel and a free flap rotatably attached to said flap base, and straps attached to said flap base and said bag front wall, said straps extending between said bag front wall and said beach towel.

2. The bag with storage pocket which converts into a beach towel of claim 1 wherein said bag front wall is attached to said beach towel along the perimeter of said bag front wall except that a portion of the perimeter of said bag front wall is not attached to said beach towel, the unattached portion of said bag front wall and the beach towel adjacent said unattached portion of the perimeter of said bag front wall forming a bag mouth.

3. The bag with storage pocket which converts into a beach towel of claim 2 further comprising a pair of shoulder straps attached to said bag with storage pocket which converts into a beach towel.

4. The bag with storage pocket which converts into a beach towel of claim 3 wherein each said shoulder strap has one end attached to said flap and the other end passes through a strap loop attached to the bottom of said bag, and each said shoulder straps further comprises:

a plurality of strap hook and loop material attached to and disposed along the length of said shoulder strap, and mating hook and loop material attached to the end of said strap which is not attached to said flap.

5. The bag with storage pocket which converts into a beach towel of claim 4 wherein said flap is comprised of:

a flap base attached to said beach towel, a free flap rotatably attached to said flap base, a storage pocket zipper wall attached along its perimeter to said free flap, said storage pocket zipper wall and the free flap adjacent said storage pocket zipper wall forming a storage pocket, and a storage pocket zipper installed in said storage pocket zipper wall wherethrough items to be stored may be introduced into said storage pocket and whereby said items to be stored may be securely held within said storage pocket.

6. The bag with storage pocket which converts into a beach towel of claim 5 further comprises:

flap hook and loop material attached to said flap, and bag front wall hook and loop material attached to said bag front wall whereby said flap hook and loop material may be mated with said bag front wall hook and loop material in order to close said bag.

7. The bag with storage pocket which converts into a beach towel of claim 2 further comprising a singular shoulder strap attached to said bag with storage pocket which converts into a beach towel, a plurality of singular shoulder strap hook and loop material being attached along the length of said singular shoulder strap.

8. The bag with storage pocket which converts into a beach towel of claim 7 further comprising;

a pair of shoulder strap loops attached to said flap, each end of said singular shoulder strap passing through one shoulder strap loop, and singular shoulder strap end hook and loop material attached to the ends of said singular shoulder strap whereby the length of said singular shoulder strap may be adjusted by changing the singular shoulder strap hook and loop material with which the singular shoulder strap end hook and loop material mates.

9. The bag with storage pocket which converts into a beach towel of claim 2 wherein the shape of said bag front wall is a rectangle.

10. The bag with storage pocket which converts into a beach towel of claim 2 wherein the shape of said bag front wall is a rectangle incorporating a curved wall.

11. The bag with storage pocket which converts into a beach towel of claim 2 wherein the shape of said bag front wall is a rectangle incorporating bag side indentations.

* * * * *